US009784478B2

(12) United States Patent
Hurtado

(10) Patent No.: US 9,784,478 B2
(45) Date of Patent: Oct. 10, 2017

(54) SYSTEMS AND METHODS FOR USING TWO REFRIGERANTS, AUGMENTATION AND EXPANSION VALVES TO ENHANCE MECHANICAL ADVANTAGE

(71) Applicant: Arthur F. Hurtado, Riverside, CA (US)

(72) Inventor: Arthur F. Hurtado, Riverside, CA (US)

( * ) Notice: Subject to any disclaimer, the term of this patent is extended or adjusted under 35 U.S.C. 154(b) by 521 days.

(21) Appl. No.: 14/048,523

(22) Filed: Oct. 8, 2013

(65) Prior Publication Data

US 2014/0102130 A1 Apr. 17, 2014
US 2017/0191701 A9 Jul. 6, 2017

Related U.S. Application Data

(63) Continuation-in-part of application No. 13/552,599, filed on Jul. 18, 2012, now abandoned, which is a continuation-in-part of application No. 13/530,097, filed on Jun. 21, 2012, now abandoned, which is a continuation-in-part of application No. 13/011,729, filed on Jan. 21, 2011, now Pat. No. 8,539,772.

(60) Provisional application No. 61/795,143, filed on Oct. 12, 2012.

(51) Int. Cl.

| | |
|---|---|
| ***F25B 1/00*** | (2006.01) |
| ***F25B 1/02*** | (2006.01) |
| ***F25B 11/02*** | (2006.01) |
| ***F25B 27/00*** | (2006.01) |
| ***F01K 25/08*** | (2006.01) |

(52) U.S. Cl.
CPC ..... *F25B 1/02* (2013.01); *F01K 25/08* (2013.01); *F25B 11/02* (2013.01); *F25B 27/00* (2013.01); *F25B 2327/00* (2013.01); *F25B 2400/14* (2013.01)

(58) Field of Classification Search
CPC .. F25B 27/00; F25B 1/02; F25B 11/02; F25B 27/005; F25B 2327/00; F25B 2400/14; F01K 25/08
See application file for complete search history.

(56) References Cited

U.S. PATENT DOCUMENTS 4,033,141 A * 7/1977 Gustafsson ..... F25B 29/00 60/651
4,414,812 A * 11/1983 Parry ..... F02G 1/02 126/573
4,617,801 A 10/1986 Clark
4,691,515 A 9/1987 Ehrig
4,747,271 A 5/1988 Fischer
(Continued)

*Primary Examiner* — Elizabeth Martin

(57) ABSTRACT

A mechanical leverage system comprising an expansive side and a compressive side, wherein the compressive side comprises a compressor which is in controlled fluid communication with a first evaporator and a first condenser, wherein the expansive side comprises an expander which is in controlled fluid communication with a second evaporator and a second condenser, wherein the second evaporator absorbs heat from a space such as an attic and drives the expander, and thus, the compressor to which the expander is connected, and wherein there is a difference between the properties of the refrigerant used in the expansive side and the compressive side, such that the difference in refrigerant properties influences the mechanical advantage ratio of the system.

13 Claims, 8 Drawing Sheets

(56) References Cited

U.S. PATENT DOCUMENTS

| | | | | |
|---|---|---|---|---|
| 4,779,427 | A | 10/1988 | Rowley | |
| 4,790,477 | A | 12/1988 | Forkin | |
| 4,876,856 | A * | 10/1989 | Iishiki | F01D 15/005 60/651 |
| 5,014,770 | A | 5/1991 | Palmer | |
| 6,533,026 | B1 | 3/2003 | Noah | |
| 8,539,772 | B2 | 9/2013 | Hurtado | |
| 2008/0163625 | A1 | 7/2008 | O'brien | |
| 2009/0165456 | A1 * | 7/2009 | Masada | F01K 9/003 60/531 |
| 2010/0107633 | A1 | 5/2010 | Tsao | |
| 2011/0179788 | A1 * | 7/2011 | Hurtado | F03G 7/06 60/641.6 |
| 2013/0180243 | A1 * | 7/2013 | Hurtado | F03G 7/04 60/641.6 |

* cited by examiner

SYSTEMS AND METHODS FOR USING TWO REFRIGERANTS, AUGMENTATION AND EXPANSION VALVES TO ENHANCE MECHANICAL ADVANTAGE

CROSS-REFERENCE TO RELATED APPLICATIONS

This application claims the benefit of U.S. Provisional Application No. 61/795,143, filed Oct. 12, 2012. This application is also a continuation-in-part and claims the benefit of the U.S. Non-provisional application Ser. No. 13/552,599 filed Jul. 18, 2012 which is a continuation in part of U.S. Non-provisional application Ser. No. 13/530,097 filed Jun. 21, 2012, which is a continuation in part of U.S. Non-provisional application Ser. No. 13/011,729 filed Jan. 21, 2011. All prior filed applications mentioned above are hereby incorporated by reference to the extent that they are not conflicting with the present application.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

The present invention relates generally to air conditioning systems and particularly to air conditioning systems configured to use mechanical leverage induced by the use of two refrigerants having different properties in order to save or produce energy.

2. Description of the Related Art

There is presently an air conditioning system using mechanical advantage. In which the mechanical advantage is derived from the displacement of a greater volume of refrigerant in the expansive side relative to the compressive side of the system.

Currently the industry is using conventional two-chamber air conditioning systems using an evaporator, a condenser and a compressor to move refrigerant vapors from the evaporator to the condenser are well known. The problem is that these systems are high consumers of electrical energy, and therefore, economically less and less attractive as energy becomes more and more scarce and expensive.

Attempts were also made to design systems that would capture the heat in the attic or other forms of heat energy for the purpose of using it in air conditioning applications, pool heating, refrigeration applications and electrical energy generation. The problem with these systems is that they are difficult and expensive to build and overall inefficient.

Therefore, a new, inexpensive, versatile and more efficient energy saving system using mechanical advantage induced by using two refrigerants, having different properties, is needed to further improve air conditioning using mechanical advantage and take advantage of the abundantly and freely available ambient heat energy, such as heat from the attic, and/or other forms of heat energy such as the renewable solar energy.

The problems and the associated solutions presented in this section could be or could have been pursued, but they are not necessarily approaches that have been previously conceived or pursued. Therefore, unless otherwise indicated, it should not be assumed that any of the approaches presented in this section qualify as prior art merely by virtue of their presence in this section of the application.

BRIEF SUMMARY OF THE INVENTION

In one embodiment, a mechanical leverage system using in conjunction two refrigerants having a difference of properties such that the differences influences the mechanical advantage ratios of the system.

In another embodiment, a mechanical leverage system using conjunction with temperature differences found in the environment is utilized for air conditioning. The mechanical leverage system provides a means for altering boiling point temperatures of refrigerants in which the system is enabled to absorb and expel heat within the temperature differentials found in the environment.

Suitable heat donors and receivers for this process to proceed are needed. This may be economically obtained through heat differences occurring naturally in our environment. Environmental temperature differences are usually ample in supply. For example, temperatures of 120 degrees F. may be readily obtained by utilizing heat from attic spaces and heat collecting devices such as solar panels and parabolic mirrors. Conversely, cooler ambient air temperatures are also readily obtainable. Hence, an advantage of the system is the ability to use ambient heat and/or solar energy collected from the environment to power an air conditioning installation and, thus, to save energy.

In another embodiment, a mechanical leverage system using refrigerants in conjunction with temperature differences found in the environment is used for collecting heat energy from the environment for the purpose of generating electricity. Thus, an advantage of the system is the ability to convert plentifully available ambient heat energy and/or solar energy into electrical energy.

In another embodiment, input of energy may be applied to augment the system, when necessary to supplement the amount of heat energy collected from the environment.

The above embodiments and advantages, as well as other embodiments and advantages, will become apparent from the ensuing description and accompanying drawings.

BRIEF DESCRIPTION OF THE DRAWINGS

For exemplification purposes, and not for limitation purposes, embodiments of the invention are illustrated in the figures of the accompanying drawings, in which.

DETAILED DESCRIPTION OF THE PREFERRED EMBODIMENTS

Figure 1:
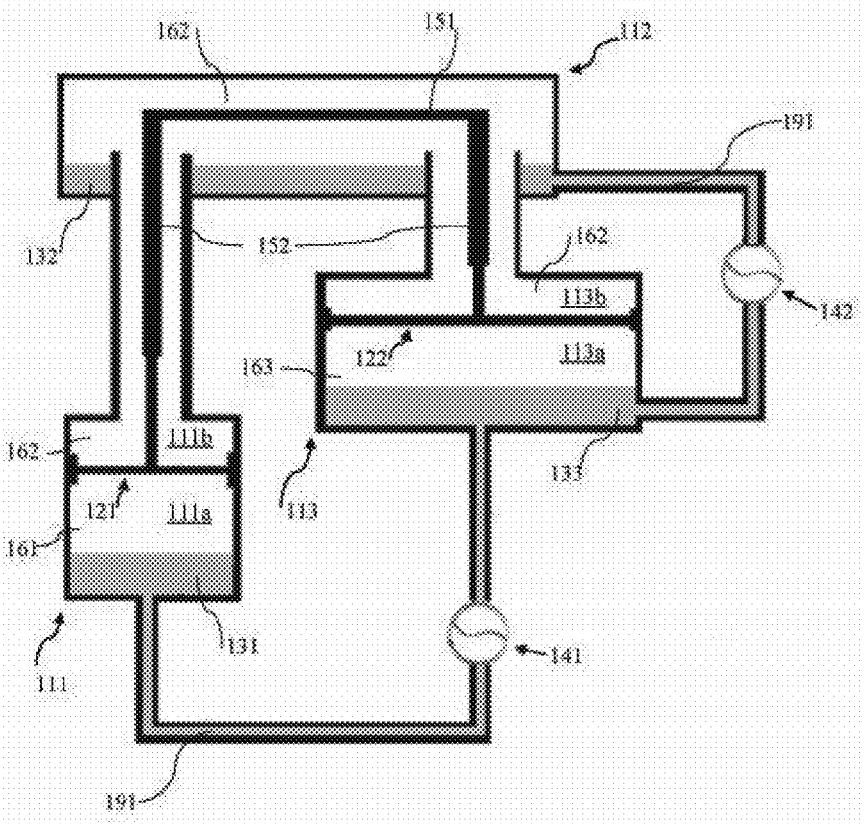
FIG. 1 illustrates a diagrammatic view of an air conditioning system, using mechanical leverage and refrigerant, according to one embodiment.

What follows is a detailed description of the preferred embodiments of the invention in which the invention may be practiced. Reference will be made to the attached drawings, and the information included in the drawings is part of this detailed description. The specific preferred embodiments of the invention, which will be described herein, are presented for exemplification purposes, and not for limitation purposes. It should be understood that structural and/or logical modifications could be made by someone of ordinary skills in the art without departing from the scope of the present invention. Therefore, the scope of the present invention is defined by the accompanying claims and their equivalents.

FIG. 1 illustrates a diagrammatic view of an air conditioning system, using mechanical leverage and refrigerant, according to one embodiment. In general, refrigerants that are suitable for air conditioning consist of refrigerants having substantial latent heat of vaporizations and high vapor pressures with boiling points within the parameters of environmental temperatures. It is to be noted that, for exemplification purposes, in the systems depicted in FIG. 1 and in the subsequent figures the refrigerant used is ammonia (NH3).

The system in FIG. 1 comprises first chamber 111 containing first piston 121, which is configured to have the capability of moving hermetically inside first chamber 111. Hence, first chamber 111 is in effect also a cylinder for first piston 121. Thus, at various times in the system's cycle, first piston 121 effectively divides first chamber 111 into two sub-chambers 111*a* (first sub-chamber) and 111*b* (second sub-chamber). Similarly, second piston 122 divides third chamber 113 into sub-chambers 113*a* (third sub-chamber) and 113*b* (fourth sub-chamber). Sub-chamber 111*a* contains ammonia liquid 131 and ammonia vapor 161 at a pressure of 6.15 bars. Sub-chamber 111*b* contains ammonia vapor 162 at a pressure of 20.33 bars. Second Chamber 112 contains ammonia liquid 132 and ammonia vapor 162 at a pressure of 20.33 bars. Sub-chamber 113*b* contains ammonia vapor 162 at a pressure of 20.33 bars. Sub-chamber 113*a* contains ammonia liquid 133 and ammonia vapor 163 at a pressure of 15.54 bars.

It should be understood that the vertical configuration of the two pistons in FIG. 1 is used for illustration purposes only. Other configurations may be used (e.g. horizontal or inclined configurations) without departing from the scope of the invention.

Second sub-chamber 111*b* communicates with second chamber 112, which contains ammonia vapor 162 at a pressure of 20.33 bars. Next, second chamber 112 communicates with fourth sub-chamber 113*b*. Finally, third sub-chamber 113*a*, contains liquid ammonia 133 and ammonia vapors at a pressure of 15.54 bars, and it is configured to communicate controllably with first sub-chamber 111*a* and second chamber 112, with the aid of counter resistance 141 and pump 142, respectively. The counter resistance 141 may be a release valve, which may be used to release as needed some of the liquid ammonia 133 from third sub-chamber 113*a* into first sub-chamber 111*a*. The pump 142 may be used to pump as needed some of the liquid ammonia 133 from third sub-chamber 113*a* into second chamber 112.

First piston 121 and second piston 122 are communicated by a hydraulic system, comprising hydraulic members 152 and hydraulic hose 151, and are counter balanced against each other. The non-compressible fluid of the hydraulic system transfers pressure from one piston to the other making the actions of the pistons responsive to one another. Thus, it is ensured that, when the equilibrium is disturbed, the distance traveled by first piston 121 is equaled with the distance traveled by second piston 122. The pistons are mechanized by a push/pull action in that the energy from vaporization will push the first piston 121 and, conversely, the energy from condensation will pull the second piston 122.

The balancing of the two pistons is achieved by using a piston system, where second piston 122 has a larger surface area than first piston 121 in order to compensate for pressure differences. It is well established that:

$$(\text{Difference in pressure 1})\times\text{Area 1}=(\text{Difference in pressure 2})\times\text{Area 2}$$

From the above formula it may be deducted that in a leverage system, if the difference in vapor pressure acting on the first piston is larger than the difference of pressure acting on the second piston, then the surface area of the first piston is smaller than the surface area of the second piston. Furthermore, since the vapor pressure of refrigerants are proportional to temperature, the temperature differential associated with the first piston having the smaller surface area is greater than the temperature differential associated with the second piston having the larger surface area.

Again, for exemplification purposes, let's assume that first sub-chamber 111*a* contains liquid ammonia 131 at a pressure of 6.15 bars. The boiling point of ammonia at this pressure is 50 degrees Fahrenheit (F). Thus, at the temperature of 50 degrees F. or greater, the liquid ammonia 131 will boil filling with ammonia vapors 161 all available space delimited by the walls of first sub-chamber 111*a* and first piston 121. The second chamber 112 contains liquid ammonia 132 at a pressure of 20.33 bars. The boiling point of ammonia at this pressure is 122 degrees F. Thus, at the temperature of 122 degrees F. or greater, the liquid ammonia 132 will boil filling with ammonia vapors 162 all available space delimited by first piston 121, the walls of second sub-chamber 111*b*, the walls of second chamber 112, the walls of fourth sub-chamber 113*b*, and second piston 122. The third sub-chamber 113*a* contains liquid ammonia 133 and ammonia vapors 163 at a pressure of 15.54 bars. The boiling point of ammonia at this pressure is 104 degrees F. Thus, at the temperature of 104 degrees F. or lower, the ammonia vapors 163 in third sub-chamber 113*a* will condense joining the liquid ammonia 133.

To summarize, first sub-chamber 111*a* contains ammonia at a pressure of 6.15 bars and a temperature of 50 degrees F. At these parameters, one kilogram (kg) of ammonia vapor 161 occupies a volume of 0.2056 cubic meters. Second chamber 112 contains ammonia at a pressure of 20.33 bars and a temperature of 122 degrees F. At these parameters, one kilogram of ammonia vapor 162 occupies a volume of 0.0635 cubic meters. Finally, third sub-chamber 113*a* contains ammonia at a pressure of 15.54 bars and a temperature of 104 degrees F. At these parameters, one kilogram (kg) of ammonia vapor 163 occupies a volume of 0.0833 cubic meters.

At equilibrium the force exerted on piston 121 equals the force exerted on piston 122:

Force 1=Force 2

If F=P×A, or, F=ΔP×A, then:

$$(P2-P1)\times A1=(P2-P3)\times A2; \quad \text{(Eq. 1);}$$

P1 is the pressure (6.15 bars) in first sub-chamber 111*a*; P2 is the pressure (20.33 bars) in second sub-chamber 111*b*, second chamber 112 and fourth sub-chamber 113*b*; P3 is the pressure (15.54 bars) in third sub-chamber 113*a*; A1 is the surface area of piston 121; A2 is the surface area of piston 122.

Then, if, for example, A1=1 sq·meter, then (20.33−6.15) bars×1 sq·meter=(20.33−15.54) bars×A2, or:

14.18=4.79 (A2)

It results that, A2=2.96 sq·meters.

Since both pistons are interconnected, if first piston 121 travels 1 meter then second piston 122 also travels 1 meter. This means that:

Work 1=Work 2, or $$P1\times V1=P2\times V2 \quad \text{(Eq. 2), or}$$

$$P1\times A1\times S1=P2\times A2\times S2; \quad \text{(Eq. 3);}$$

S1=S2=1 meter; then, 14.18 bars×1 sq·meter×1 meter=4.79 bars×2.96 sq·meters×1 meter, or 14.18 bars×cubic·meter=14.18 bars×cubic·meter The ammonia in first sub-chamber 111*a* will boil and absorb heat from the room where it is placed. At 6.15 bars of vapor pressure, the temperature of the ammonia in first sub-chamber 111*a* is 50 degrees F. The ammonia at this temperature will adequately remove heat from a room where the temperature is greater than 50 degrees F. (for example, 75 degrees F.). As heat is removed from the room into first sub-chamber 111*a*, the ammonia within it will boil and will tend to equilibrate to the point of saturation. The resulting increase in ammonia vapor pressure (P1) in first sub-chamber 111*a* will translate into a pushing force exerted on first piston 121.

The second chamber 112 contains ammonia at a pressure of 20.33 bars (P2). Ammonia at this pressure requires a temperature of 122 degrees F. to boil. Heat may be acquired from ambient temperature of the attic, where second chamber 112 may be placed, and/or, from other sources, such as solar panels or reflectors, if needed. The boiling of the ammonia in second chamber 112 will result in an increase of the vapor pressure (P2), which will translate into a pushing force exerted on the first piston 121 and the second piston 122. The force exerted on second piston 122 is greater than the force exerted on first piston 121 due to the surface area of second piston 122 being greater than that of first piston 121. Hence, when, in second chamber 112, the pressure P2, which at system equilibrium is 20.33 bars, increases, the two pistons 121, 122 move clockwise (when looking at the exemplary system depicted in FIG. 1).

Third sub-chamber 113*a* contains ammonia at a pressure of 15.54 bars (P3) and a temperature of 104 degrees F. The ammonia vapor will condense by loosing heat to the cooler outside ambient air having a temperature of, for example, 95 degrees F. The condensation of the ammonia vapor in third sub-chamber 113*a* results in a decrease of vapor pressure, and thus, will have a pulling force effect exerted on second piston 122.

As explained later, the pressure/temperature difference between chamber 2 and third sub-chamber chamber 113*a* may be narrower with the use of the leverage system. The narrowing of this pressure/temperature difference makes it possible for the system to absorb heat and expel heat within the temperature ranges found in the environment. Thus, enabling the refrigerant in second chamber 112 to boil, and subsequently condense in sub-chamber 113*a*, at narrower pressure/temperature differences between attic and outside ambient air. This is an important advantage as the environmental temperatures are invariably uncontrollable. Hence, it becomes necessary to configure the leverage system to work within these parameters.

First sub-chamber 111*a* acts as an evaporator and third sub-chamber 113*a* acts as a condenser. Again, the three interconnected chambers may be placed at different locations. First chamber 111 may be placed inside the space to be cooled, second chamber 112 may be placed in the attic, and third chamber 113 may be place outside. The forces exerted by the actions of the ammonia vapors on piston 121 and piston 122 are transferred between the two pistons by hydraulic pressure hose(s) 151 and the ammonia is transferred among the various chambers by tubing 191.

Each of the three chambers will tend to reach equilibrium with one another, as changes in temperature occur. Either by the process of boiling or condensing, each chamber will strive to maintain vapor pressures corresponding to their respective temperatures and saturation levels. The boiling and condensing of the refrigerant creates a pushing and pulling force on the pistons and drives the system forward.

The specific volume of the ammonia vapors in first sub-chamber 111*a* is 0.2056 cubic meter/kg and the specific volume of vapor in second chamber 112 is 0.0635 cubic meter/kg. The specific volume of vapor from sub-chamber 111-*a* to second chamber 112 is decreased by a factor of (0.2056/0.0635) or 3.227. This is equivalent to saying that the density of the ammonia vapors in second chamber 112 is 3.227 times greater than the density of the ammonia vapors in first sub-chamber 111*a*. The area of second piston 122 is 2.96 greater than the area of first piston 121. Therefore, second piston 122 displaces (3.227×2.96) or 9.5 times more vapor than first piston 121. The production of the required additional vapor takes place in second chamber 112. As discussed, most of the vapor production and heat absorption takes place in second chamber 112. This makes up the greatest portion of the required energy to power the system.

Fortunately, this additional energy, in the form of heat, may be derived from unwanted heat from spaces such as the attic. Higher temperatures may also be readily obtained by utilizing heating devices such as solar panels and parabolic mirrors. Solar heat collectors such as venting canal systems may also be used. Venting canals are made up of insulated panels affixed to the bottom portion of the rafters of a pitched roof. This results in a longitudinal compartment bounded by the adjacent rafters on each side and by the sheathing of the roof on the top and the insulated panels on the bottom. The longitudinal compartment or canal confines the air space below the roofline and concentrates the heat to higher temperatures. The heated air rises, within the canals, to the apex of the roof where the heat is absorbed by the boiling of the refrigerant in second chamber 112.

Second chamber 112 may be in the form of a long tube, containing refrigerant, and may be placed along the apex or ridgeline of the roof, thus, absorbing heat from the attic and/or, for example, venting canals. Hence, the boiling of the refrigerant in the tube is caused by the heat from the attic and/or the venting canals. Thus, this unwanted and abundantly available heat becomes the fuel that powers the cooling system.

There is a two-fold advantage to this process. First, the more heat is absorbed by the refrigerant in second chamber 112, the more heat is also absorbed in first chamber 111, namely its 111*a* first sub-chamber, and hence, more cooling occurs in the living area. This is because, the higher the temperature in second chamber 112, the greater is the pushing and "pulling" (because of the hydraulic link) effect on second piston 122 and first piston 121, respectively, exercised by the refrigerant gases from second chamber 112. This translates in expanded volume, and thus, lower pressure and lower temperature in first sub-chamber 111*a*, which means that more heat will be absorbed from the living area. Secondly, the heat that would normally accumulate in the attic and ultimately penetrate the living spaces of a house is diverted and absorbed by second chamber 112 of the cooling system. Consequently, this absorbed heat never has the opportunity to penetrate and heat the inside of the house.

Figure 2:
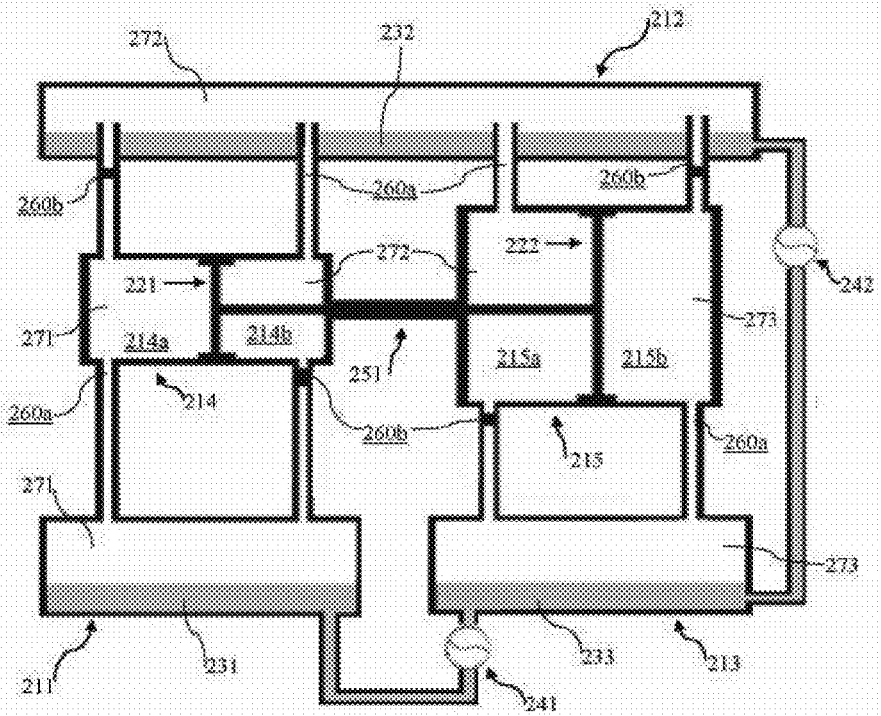
FIG. 2 illustrates a diagrammatic view of an air conditioning system, using mechanical leverage and refrigerant, according to another embodiment.

FIG. 2 illustrates a diagrammatic view of an air conditioning system, using mechanical leverage and refrigerant, according to another embodiment. The pistons and chambers from FIG. 1 are rearranged to arrive at the illustrated configuration of a pumping system that pumps vapor from first chamber 211 into second chamber 212 and ultimately into third chamber 213.

When the system is at equilibrium the parameters of temperature and pressure in the three chambers are maintained and stabilized as earlier described (first chamber 211 contains liquid ammonia 231 and ammonia vapor 271 at a pressure of 6.15 bars (P1) and a temperature of 50 degrees F.; second chamber 212 contains liquid ammonia 232 and ammonia vapor 272 at a pressure of 20.33 bars (P2) and a temperature of 122 degrees F.; third chamber 213 contains liquid ammonia 233 and ammonia vapor 273 at a pressure of 15.54 bars (P3) and a temperature of 104 degrees F.). However, the equilibrium state of the chambers become disturbed as the refrigerant boils in chambers 211 and 212 and condenses in chamber 213. The resultant change of vapor pressure in the chambers pumps the vapor through the system.

Pistons 221 and 222 are adjoined and move together as a unit, pushing the vapor through the system. The connector 251 between the two pistons 221, 222 may be a hydraulic system or link, which may comprise hydraulic member(s), such as a hydraulic piston, and hydraulic hose(s). When the four valves 260*a* are open and the four valves 260*b* are closed, as shown in FIG. 2, the two pistons move towards the right. It should be noted that, when the four valves 260*a* are open and the four valves 260*b* are closed, the pressure (P1) and the temperature of the refrigerant vapor 271 are the same in the left side 214*a* (i.e., first sub-chamber) of first cylinder 214 as in first chamber 211; the pressure (P2) and the temperature of the vapor 272 are also the same in the right side 214*b* (i.e., second sub-chamber) of first cylinder 214, and the left side 215*a* (i.e., third sub-chamber) of second cylinder 215, as in second chamber 212; finally, the pressure (P3) and the temperature of the vapor 273 are the same in the right side 215*b* (i.e., fourth sub-chamber) of second cylinder 215 as in third chamber 213. It should be understood that the horizontal configuration of the two pistons in FIG. 2 (and in the subsequent figures), and thus, the associated nomenclature (left side, right side, etc) are used for illustration purposes only. Other configurations may be used (e.g. vertical or inclined configurations) without departing from the scope of the invention.

Figure 3:
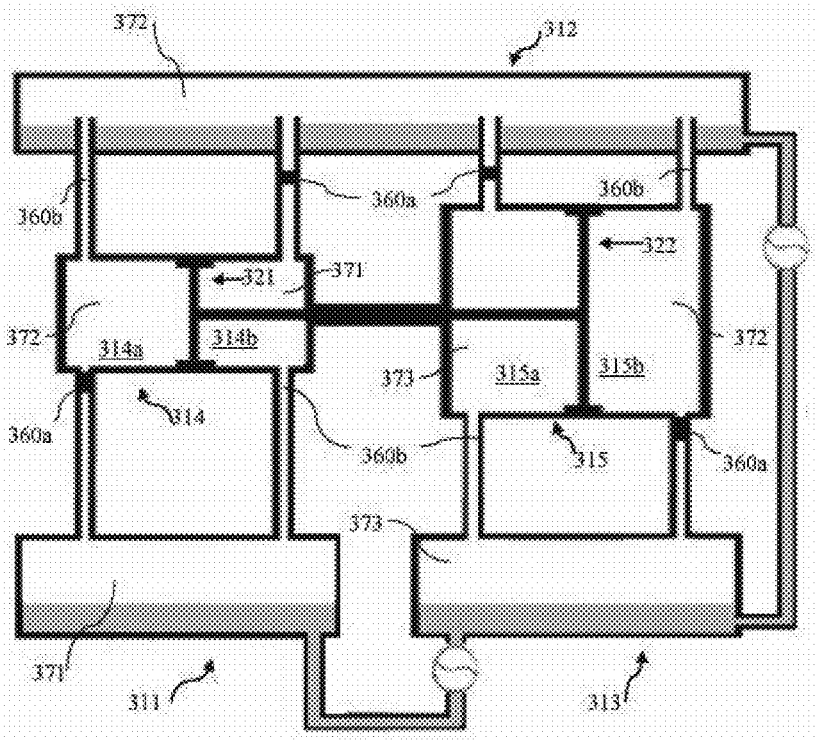
FIG. 3 illustrates a diagrammatic view of the same air conditioning system, using mechanical leverage and refrigerant, as in FIG. 2, except that, the valves that are closed in FIG. 2 are open in FIG. 3, and vice versa.

When the two pistons 221, 222 reach their end point to the right in the respective cylinders 214, 215, an electronic or a mechanical switch for example, close the four valves 260*a* and open the four valves 260*b* (as illustrated in FIG. 3 where the same valves are labeled as 360*a* and 360*b*, respectively). The polarity of pressure acting upon the system becomes reversed and the two pistons, 321 and 322 (FIG. 3), move to the left. The pressure (P1) and the temperature of the refrigerant vapor 371 (FIG. 3) are the same in the right side 314*b* (i.e., second sub-chamber) of first cylinder 314 as in first chamber 311; the pressure (P2) and the temperature of the vapor 372 are also the same in the left side 314*a* (i.e., first sub-chamber) of first cylinder 314, and the right side 315*b* (i.e., fourth sub-chamber) of second cylinder 315, as in second chamber 312; finally, the pressure (P3) and the temperature of the vapor 373 are the same in the left side 315*a* (i.e., third sub-chamber) of second cylinder 315 as in third chamber 313.

The cycle repeats when the polarity of pressure reverses again, when the pistons 321, 322 reach the end point to the left. The vapor flows continuously through the system as pistons 321 and 322 oscillate back and forth.

The condensed ammonia liquid in third chamber 213 must be recycled to first chamber 211 and second chamber 212 in proportion to their original amounts. Input of work is required at turbine 242 to pump ammonia liquid from third chamber 213 into second chamber 212, against a pressure difference of 4.79 bars (P2−P3). However, work is gained at turbine 241 as 9.39 bars (P3−P1) of ammonia liquid pressure is released from third chamber 213 into first chamber 211. A counter resistance of 9.39 bars at turbine 241 is necessary to keep the system in equilibrium.

It should be noted that the volume of chambers 211, 212 and 213 are substantially larger than the volume of cylinders 214, 215 so as to create minimal change in pressure in chambers 211, 212 and 213 as the ammonia vapor ingresses and egresses via the opening of valves 260*a* and 260*b*.

If the volume displaced by each stroke of piston 221 equals 1 cubic meter then the volume of each stroke displaced by piston 222 is 2.97 cubic meters. This is because, as it was explained earlier when describing FIG. 1, the surface area of piston 222 is 2.97 times the surface area of piston 221 in order to achieve equilibrium at the given temperature and pressure levels. In addition, as also explained earlier, because of the manner in which pistons 221, 222 are connected to each other, they travel the same distances.

As stated earlier, the specific volume of the ammonia in chamber 211 is 0.2056 cubic meter/kg, which means that its density is 4.86 kg/cubic meter. In chamber 212 the specific volume of the ammonia is 0.0635 cubic meter/kg, which means that its density is 15.74 kg/cubic meter.

From the above, it can be deducted that, with each stroke of 1 cubic meter, the amount of ammonia vapor displaced by first piston 221 is 4.86 kg. In the same time, the amount of ammonia vapor displaced by piston 222 is 46.59 Kg (15.74 kg/cubic meter×2.96 cubic meters). Thus, the ratio of ammonia to be recycled back into chamber 211 and chamber 212 is 4.86/46.59 or 1:9.5, respectively.

The work required to return the liquid ammonia to the respective chambers is a function of its density or volume and the pressure difference of the respective chambers (the specific volume of liquid ammonia is 0.0015 cubic meter/kg):

Work=V(P1−P2)

Work Gain (4.86 kg moved from chamber 213 to chamber 211):

Work 1=4.86 kg(0.0015 cubic meter/kg)(6.15−15.54) bars, or

Work 1=4.86 kg.(0.0015 cubic meter/kg)(−9.39) bars, or

Work 1=−0.0684 cubic meter×bar

Since one part of liquid ammonia (i.e., 4.96 kg) is returned to chamber 211, the difference of 41.73 kg (i.e., 46.59 kg−4.86 kg) is returned to chamber 212.

Work Expended (41.73 kg moved from chamber 213 to chamber 212)

Work 2=41.73 kg.(0.0015 cubic meter/kg)(20.33−15.54) bars, or

Work 2=41.73 kg.(0.0015 cubic meter/kg)(4.79) bars, or

Work 2=0.2998 cubic meter×bar

Net Work Expended=(0.2998−0.0684)=0.231 cubic meter×bar

Figure 4:
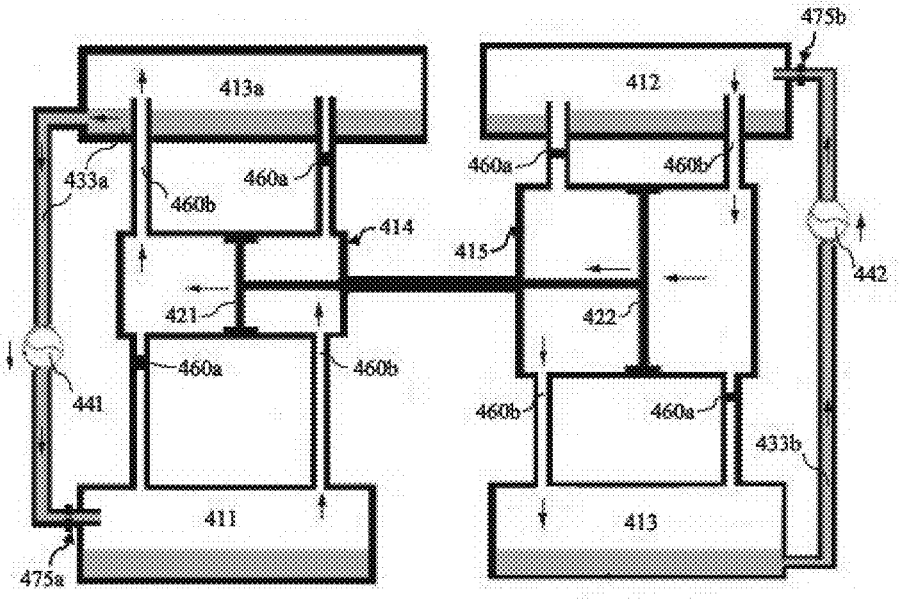
FIG. 4 is a schematic view of a reciprocal piston based mechanical advantage/leverage system comprising two refrigerants with different properties, in accordance with several embodiments.

Referring now to FIG. 4, a schematic view of an improved reciprocal piston based mechanical advantage/leverage systems is depicted, in accordance with several embodiments. Reciprocal piston systems were also described earlier herein when referring for example to FIGS. 2-3. One difference in the system depicted in FIG. 4 is that the system has two evaporators (411, 412) and two condensers (413, 413*a*). It is noted that either piston 421 or piston 422 may be substituted with a rotor type (discussion forthcoming) or any other devise that produces the same means and may be used in conjunction with any of the embodiments discussed herein. A separate evaporator and condenser for the compression side of the system (411, 413*a*) and a separate evaporator and condenser for the expansive side of the system (412, 413). This configuration allows for more flexibility on how to operate the system. For example, as it will be explained in more details below, two types of refrigerants with different properties may be used and kept separate. This is particularly useful when, for example, there is a small differential between the temperature of the attic (or other heat source) and the outside ambient air.

As previously discussed, heat may be obtained from the attic space, or other sources, and converted into useful energy. A mechanical advantage/leverage system used in conjunction with a refrigerant may derive energy from the temperature differences between the attic space or other sources and the outside ambient air for example. This energy may then be leveraged by the mechanical advantage system to run an air conditioning system for example, or other devices (e.g., a generator).

Again, in the reciprocal piston system, two pistons may be interconnected to one another and actuated by the push/pull action of the refrigerant as it vaporizes and condenses. As shown, for the system to create mechanical advantage/leverage, the surface area of the first piston (421; FIG. 4) in cylinder 414 is preferably smaller than the surface area of the second piston (422; FIG. 4) in cylinder 415. In this example piston-cylinder assembly 422/415 acts as an expander and piston-cylinder assembly 421/414 acts as a compressor.

As stated before, it is well established that: (Difference in pressure 1)×Area 1=(Difference in pressure 2)×Area 2. This equation is central to the mechanical leverage system. From this equation it may be deducted that, if the difference in vapor pressure acting on the first piston is larger than the difference of pressure acting on the second piston, then the surface area of the first piston is smaller than the surface area of the second piston. Since the vapor pressure of refrigerants is proportional to their temperature, the temperature differential associated with the first piston, having the smaller surface area, is greater than the temperature differential associated with the second piston, having the larger surface area. Furthermore, increasing the surface area of the second piston in relation to the first piston decreases the pressure/temperature difference necessary to act on the second piston, thus, making it possible for the system to work within the temperature ranges found within the environment (e.g., attic temperature and outside temperature).

As shown in FIG. 4, second piston 422 and first piston 421 move to the left and valves 460*a* are closed while valves 460*b* are open. It should be apparent that the process is reversed and both pistons move to the right when valves 460*a* are open and valves 460*b* are closed.

In this embodiment, two refrigerants having different vapor pressures at given temperatures may be used to obtain mechanical advantage as described herein below.

The following chart (Chart 1) is an illustration of a mechanical advantage system as depicted in FIG. 4 and using refrigerant R-134a in all four chambers.

CHART 1

| (refrigerant R-134a) | | |
|---|---|---|
| Chamber 411: | Temperature 60 F. | Pressure 57.4 psi |
| Chamber 412 and 2613a: | Temperature 120 F. | Pressure 171.1 psi |
| Chamber 413: | Temperature 110 F. | Pressure 146.3 psi, |

wherein, chamber 411 is the evaporator and chamber 413*a* is the condenser for the compression side of the system and chamber 412 is the evaporator and chamber 413 is the condenser for the expansion side of the system. As described before, chamber 411 may be placed in a room to extract heat from it, chamber 413 may be placed outside to expel the heat there, and chamber 412 may be placed in the attic to absorb the heat accumulated there or it may be configured to use solar heat or heat from the roof as described earlier herein. The fourth chamber (413*a*), which is present in the system depicted in FIG. 4, may also be placed outside, to expel the heat there while the refrigerant condensates in it.

Using the parameters listed in Chart 4 and if A1=1 unit, and chamber 411 is P1, chamber 412 is P2, chamber 413 is P3 and chamber 413*a* is P4, we have:

$$(P4-P1)A1 = (P2-P3)A2$$

Compressive Side Expansive Side $$(171.1-57.4)psi \text{ sq. in.} = (171.1-146.3)psi \times A2.$$

$$113.7\ psi \text{ sq. in.} = 24.8\ psi(A2)$$

$$A2 = 4.58 \text{ sq in.}$$

Thus, a mechanical advantage of at least 4.58 is required for the system from FIG. 4 to operate using R-134a refrigerant in all four chambers.

The following chart (Chart 2) is an illustration of a similar mechanical advantage system as in FIG. 4 but using refrigerant R-410a instead of R-134a. For the purpose of this illustration, the temperature parameters remain the same. However, the vapor pressure values differ due to the change in refrigerant used.

CHART 2

| (refrigerant R-410a) | | |
|---|---|---|
| Chamber 411: | Temperature 60 F. | Pressure 170.7 psi |
| Chamber 412 and 2613a: | Temperature 120 F. | Pressure 416.4 psi |
| Chamber 413: | Temperature 110 F. | Pressure 364.1 psi |

Using the parameters listed in Chart 2 and if A1=1 unit, we have:

$$(P4-P1)A1=(P2-P3)A2$$

$$(416.4-170.7)\text{ psi sq. in.}=(416.4-364.1)\text{ psi}\times A2.$$

$$245.7\text{ psi sq. in.}=52.3\text{ psi}(A2)$$

$$A2=4.69\text{ sq in.}$$

Thus, using the same temperature parameters as in Chart 4 (R-134a refrigerant), a mechanical advantage of at least 4.69 is required for the system depicted in FIG. 4 to operate if refrigerant R-410a is used in the system instead of R-134a refrigerant. It should be observed that, the mechanical advantage (4.58) using R-134a is very much similar to that of using R-410a (4.69).

The following chart (Chart 3) is an illustration of a mechanical advantage system depicted in FIG. 4 using a combination of refrigerants, namely using refrigerant R-134a on the compressive side and R-410a on the expansive side. Again, for illustration purposes, the temperature parameters remain the same.

CHART 3

| (Refrigerant R-134a and R-410a) | | | |
|---|---|---|---|
| Chamber 411: | Temperature 60 F. | Pressure 57.4 psi | Refrigerant R-134a |
| Chamber 412 | Temperature 120 F. | Pressure 416.4 psi | Refrigerant R-410a |
| Chamber 413: | Temperature 110 F. | Pressure 364.1 psi | Refrigerant R-410a |
| Chamber 413a: | Temperature 120 F. | Pressure 171.17 psi | Refrigerant R-134a |

If A1=1 unit, we have $$\begin{aligned} \text{Compression Expansion} \\ (P4-P1)A1 &= (P2-P3)A2 \\ (171.1-57.4)\,psi\,\text{sq. in.} &= (416.4-364.1)psi\times A2. \\ 113.7\,psi\,\text{sq. in.} &= 52.3\,psi\,(A2) \\ A2 &= 2.17\,\text{sq in.} \end{aligned}$$

Thus, a mechanical advantage of at least 2.17 is required for the system depicted in FIG. 4 to operate if refrigerant R-134a is used on the compressive side and R-410a is used on the expansive side. It should be noted that in using refrigerant R-134a in the expansive portion of the system, particularly in the evaporator in the attic (chamber 412) at 120 F and the condenser (chamber 413) at 110 F yields a pressure difference of (171.1–146.3) psi or 24.8 psi. In comparison, using R-410a in the same expansive system and same temperature parameters, yields a pressure of (416.4–364.1) psi or 52.3 psi. Thus, R-410a refrigerant yields approximately twice (52.3/24.8=2.1 psi) the pressure as the R-134a refrigerant, at the same temperature differential. Typically, refrigerants yielding greater pressure differentials relative to one another with respect to a given temperature differential, produce a greater mechanical advantage. With this in mind, desired mechanical advantages can be obtained by using suitable refrigerants having the appropriate vapor pressure properties.

In the above illustration (Chart 3), using R-134a on the compressive side of the system and using R-410a on the expansive side of the system, only half of the mechanical advantage is required to operate the system as compared to using only one refrigerant for the entire system. This is particularly useful when there is a small differential between the temperature of the attic and the outside ambient air.

The use of two refrigerants with different temperature/vapor pressure properties provides a method for obtaining leverage in which the mechanical advantage is induced chemically rather than the traditional mechanical method, as discussed previously herein, referring in particular wherein mechanical advantage is the result of the expansive side displacing a greater volume of gas than does the compressive side. However, using a combination of both methods (chemically induced and traditional mechanical advantage) would probably be more advantageous in many applications.

The following is an example of a system using both chemically induced mechanical advantage and traditional mechanical advantage. In the previous discussion, the use of two refrigerants, using the parameters listed in chart 3, yield a chemically induced mechanical advantage of 2.17. Incorporating a further increase of volume displacement by the expansive piston 422 relative to the compressive piston 421 of FIG. 4, implements an additional mechanical advantage, (traditional), element. For example, an increase of displacement of piston 422 by a factor of 3, produces a combined chemically induced and traditional mechanical advantage of 2.17×3=6.51. Thus we have a total combined mechanical advantage of 6.51. This discussion does not restrict the ratio of the volume of gas-phase refrigerant displaced by the compressive side versus the expansive side and is not limited to the examples given in this disclosure. The ratio of displacement may be greater, lesser or equal to 1.

Again, having separate condensers for each side, the compression side and the expansive side of the system depicted in FIG. 4, allows for more flexibility to operate the system. As demonstrated in the above illustrations, two types of refrigerants with different properties may be used and kept separate in order to achieve the described benefits. Also as illustrated above, each condenser, either being from the compressive or the expansive side of the system, may operate at different temperature/pressures with respect to one another. This flexibility facilitates easy adaptation of the system to specific applications and conditions.

It is also noted that using two separate condensers when using only one refrigerant may also provide for more flexibility with regard to operating a system. Again as illustrated above, each condenser, either being from the compressive or the expansive side of the system, may operate at different temperature/pressures with respect to one another. For example the refrigerant in condenser 413*a* on the compressive side of the system may be configured to condense at temperatures different and independent to that of the condenser 413 on the expansive side of the system, depending on the application.

In another embodiment, the system from FIG. 4 implements the use of expansion valves (475*a*, 475*b*) in each of the evaporators (chamber 411 and chamber 412). As shown in FIG. 4, liquid refrigerant 433*a* and 433*b* is compressed and pumped by pumps 441 and 442, respectively, through the expansion valves 475*a* and 475*b*, respectively. To facilitate evaporation, the high pressurized liquid refrigerant 433*a* and 433*b* may be in the form of a spray as it is emitted through the expansion valves 475*a* and 475*b*, respectively. As the high pressure liquid refrigerant is released into the low pressure evaporator (411 and 412), it quickly evaporates into a gas, absorbing heat from its surroundings at an accelerated rate.

Thus, pump 441 compresses liquid refrigerant 433*a* to a pressure high enough to cause rapid vaporization of the refrigerant, as it enters the lower pressure of the evaporator 411. In the process, heat is absorbed rapidly from the space (e.g., living space) where the evaporator 411 is placed.

Similarly, pump 442 compresses liquid refrigerant 433*b* to a pressure high enough to cause rapid vaporization of the refrigerant, as it enters the lower pressure of the evaporator 412. In the process, heat is also absorbed rapidly from the space (e.g., attic) where evaporator 412 is placed.

Figure 5A:
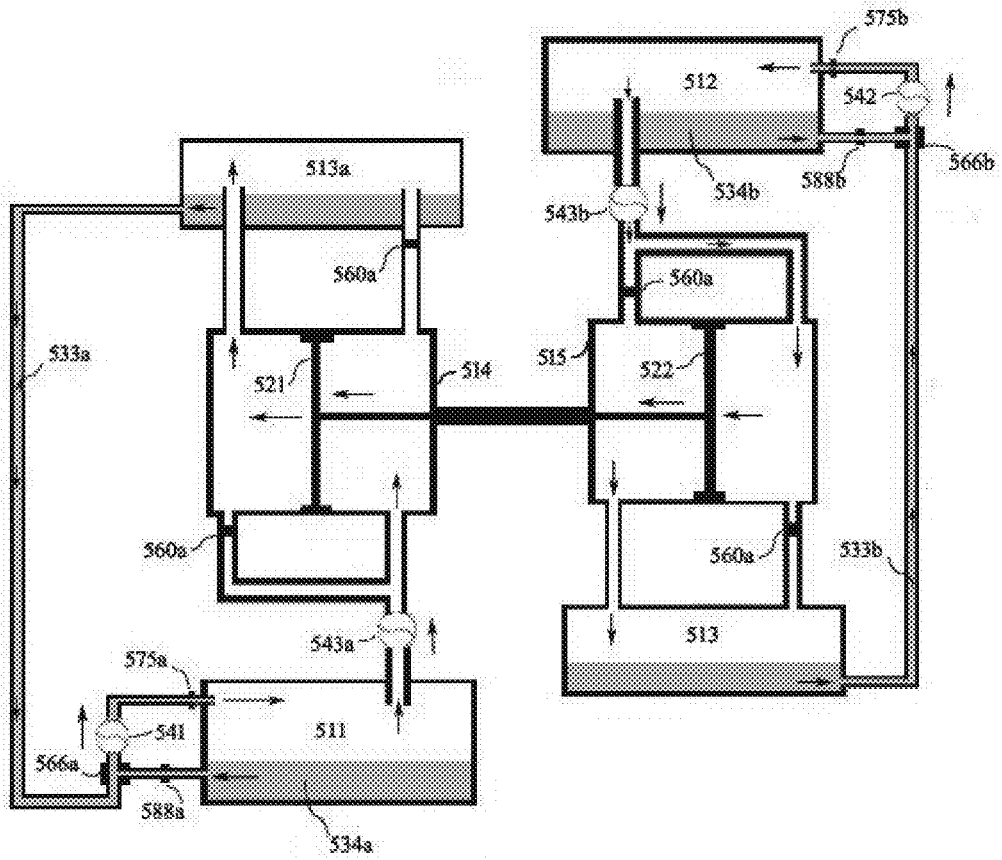
FIGS. 5*a-b* are schematic views of a reciprocal piston based mechanical advantage/leverage system in different system states, in accordance with other embodiments.
Figure 5B:
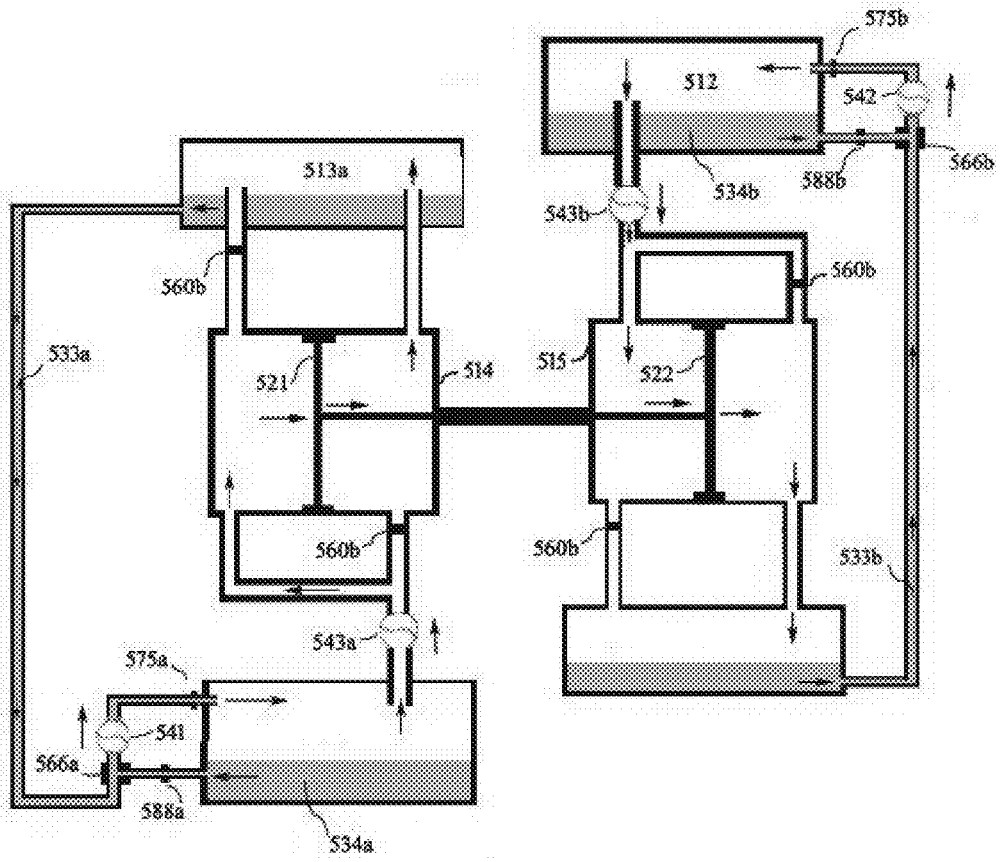

Referring now to FIGS. 5*a-b*, a schematic view of an improved reciprocal piston based mechanical advantage/leverage systems is depicted, in accordance with other embodiments. The system depicted in FIGS. 5*a-b* is an improved alternative of the system depicted in FIG. 4 which was described earlier in this disclosure. The improvements and modifications will be described below.

It should be noted that FIGS. 5*a-b* show the same system in different states. FIG. 5*a* shows the system when valves 560*a* are closed while valves 560*b* (see FIG. 5*b* for their location) are open, and thus, the two pistons, 521, 522, are moving to the left. FIG. 5*b* shows the system when valves 560*b* are closed while valves 560*a* (see FIG. 5*a* for their location) are open, and thus, the two pistons, 521, 522, are moving to the right. One-way valves or check valves may be placed near or at valves 560*a* and valves 560*b* (not shown here) allowing refrigerant to flow in the appropriate direction and to preclude back flow.

Pumps 541 and 542 compresses liquid refrigerant 533*a* and 533*b* to a pressure high enough to cause rapid vaporization of the refrigerant as it is compressed through expansion valves 575*a* and 675*b* and enters the lower pressure of evaporator 511 and 512 respectfully. Since the pressure in chamber 512 is higher than that of chamber 513, it is especially important that liquid refrigerant 534*b* be pumped and compressed from chamber 513 to a substantially higher pressure level than the pressure of chamber 512 in order for liquid refrigerant 534*b* to undergo a sudden drop in pressure as it is emitted through expansion valve 575*b*.

In the event the rate of vaporization is not sufficient to fully vaporize the refrigerant emitted from the expansion valve 575*b*, a recirculating mechanism may be used to pump excess liquid refrigerant that has not vaporized from evaporator 512, using pump 542, and recirculate the un-vaporized liquid refrigerant 534*b* back through the expansion valve 575*b*. The r recirculating mechanism also comprises a sensor 588*b*, located in or near the evaporator 512. When sensor 588*b* detects an accumulation of liquid refrigerant 534*b* in evaporator 512, it actuates 3-way valve 566*b*, in a first position and directs the accumulated liquid refrigerant 534*b* to be recycled by pumping it through expansion valve 575*b* and simultaneously preventing the flow of liquid refrigerant 533*b* from condenser 513. Alternatively, when sensor 588*b* detects no accumulation of liquid refrigerant 534*b* in evaporator 512 it actuates 3-way valve 566*b* in a second position and directs liquid 533*b* refrigerant from condenser 513 to be pumped through expansion valve 575*b* and simultaneously preventing the flow of liquid refrigerant 534*b* from evaporator 512. The liquid refrigerant 5343*b* being recycled from evaporator 512 will evaporate easier the second time around as it has been preheated. Similarly, In the event the rate of vaporization is not sufficient to fully vaporize the refrigerant emitted from the expansion valve 575*a*, a liquid recycling mechanism may be used to pump excess liquid refrigerant 534*a* that has not vaporized from evaporator 511, using pump 541, and recycle the un-vaporized liquid refrigerant 534*a* back through expansion valve 575*a*. The recycling mechanism also comprises a sensor 588*a*, located in or near the evaporator 511. When sensor 588*a* detects an accumulation of liquid refrigerant 534*a* in evaporator 511, it actuates 3-way valve, 566*a*, in a first position and directs the accumulated liquid refrigerant 534*a* to be recycled by pumping it through expansion valve 575*a* and simultaneously preventing the flow of liquid refrigerant 533*a* from condenser 513*a*. Alternatively, when sensor 588*a* detects no accumulation of liquid refrigerant 534*a* in evaporator 511 it actuates 3-way valve 566*a* in a second position and directs liquid refrigerant 533*a* from condenser 513*a* to be pumped through expansion valve 575*a* and simultaneously preventing the flow of liquid refrigerant 534*a* from evaporator 511.

The recycling mechanism may be implemented in either or both evaporators, (evaporator 511 and evaporator 512). The recycling mechanism described above, including the expansion valve, the sensor, 3-way valve and pump, may also be used in other evaporators, in general, including those used in conventional applications presently used in the industry as well as those used in mechanical advantage systems, as described herein, including those depicted in FIGS. 2,3 4,6 and 7.

In the event that heat from the sun, for example collected from the attic of a house, is insufficient to raise the temperature level of the refrigerant in evaporator 512, (See FIGS. 5*a*-5*b*), to a level of 120 F or high enough to drive the system, external energy may be applied to supplement the system. Wherein, the external energy supplements the work produced between evaporator 512 and condenser 513 and augments the work output of the expander, (in this example depicted by piston-cylinder assembly 522/515). The energy applied may be in the form of compressor 543*b*, compressing refrigerant vapor from evaporator 512 into piston-cylinder assembly 522/515. Additionally, compressor 541 may augment compression of refrigerant vapor from evaporator 511 into piston-cylinder assembly 521/514. Wherein, the external energy supplements the work required to compress vapor from evaporator 511 to condenser 513*a*. In this regard augmented energy may be utilized on either the compressive side or the expansive side or both.

In the mechanical advantage/leverage system depicted in FIGS. 5*a-b*, augmentation, as well as expansion valves and liquid the refrigerant recycling system are used to enhance the mechanical advantage of the system. As previously described in this disclosure, chamber 512 may be located in spaces such as the attic. It comprises an evaporator, and acts as the power source for the system.

Implementing an augmenting system between chamber 512 and piston/cylinder assembly 522/515, for example, using compressor 543*b* as described earlier when referring to FIGS. 5*a-b*, allows the system to operate with a decreased pressure level and hence boiling point of refrigerant 534*b* in chamber 512. Thus, enabling chamber 512 to absorb heat at lower temperatures. Additionally, the resulting decrease in pressure and boiling point of refrigerant 534*b* in chamber 512 facilitates and increases the rate at which liquid refrigerant 534*b* evaporates as it is emitted through expansion valve 575*b*. Greater rates of evaporation equates to greater heat absorption and cooler attic spaces and ultimately more energy available to drive the system. Additionally, augmentation using compressor 543*b* also increases the pressure in chamber 513 and thereby increasing the rate of condensation and also helps to drive the system.

In another embodiment, involving replacing the reciprocal piston mechanism with rotary turbines, rotary pumps or scroll pumps. This may be advantageous in that rotary turbines do not require valves, hence, are simpler in design and are more reliable than reciprocal pumps. A two-cycle piston/cylinder system may also be used since it operates using ports and works without the use of valves. It should be noted that many other types of devises resulting in similar means may be used for this application and it is not the intent of this invention to be limited to the methods discussed here or elsewhere.

The same principles described above when referring to the reciprocal piston mechanisms (see description above referring to FIGS. 1-5) are applicable when using instead rotary turbines. An exemplary system, similar to that depicted in and described when referring to FIGS. 5*a-b*, but in which piston 521 and piston 522 were replaced with rotary turbines 616 and 617, respectively, and augmenting compressor 543*b* is replaced with augmenting device 643 is shown in FIG. 6.

Figure 6:
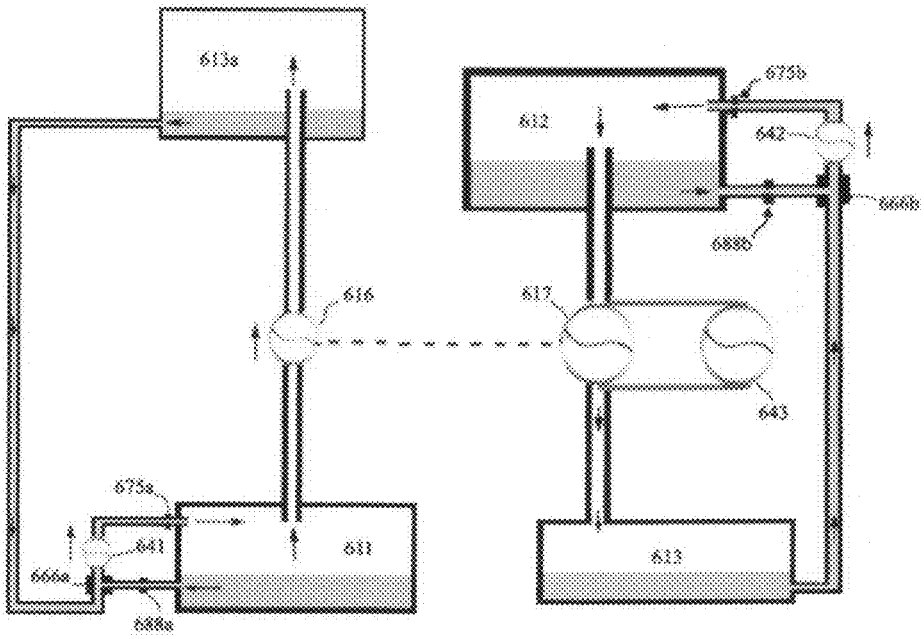
FIG. 6 is a schematic view of a turbine based mechanical advantage/leverage system, in accordance with other embodiments.

Referring to FIG. 6, as in the mechanical leverage system using the reciprocal piston system, rotary turbine 617 displaces larger volumes of refrigerant than rotary turbine 616. In this example rotary turbine 617 acts as an expander and rotary turbine 616 acts as a compressor. The forces acting on the two turbines are interconnected with one another, creating a mechanical advantage system. Hence, at equilibrium, the pressure difference acting upon the smaller rotary turbine 616 is greater than the pressure difference acting upon the larger rotary turbine 617. The two rotary turbines are interconnected by an axle or other means in a manner in which the forces acting on rotary turbine 617 is transferred to rotary turbine 616 and vice versa. In this situation, the smaller rotary turbine 616 acts as a compressor and the larger rotary turbine 617 acts as an expander or pneumatic motor. The pneumatic 617 motor generates energy sufficient to operate the compressor rotor 616. Besides rotary turbines, rotary pumps, scroll pumps and the like may also be used for this application. For the purpose of this disclosure, the term turbine will be adopted, rather than pump, since pump pertains to compression and turbine may pertain to both compression and expansion.

Referring to FIG. 6, the augmenting device/motor 643 may be that of an electric motor powering the expander 617 and in turn driving the compressor 616 of an air conditioner. The augmenting motor 643 may be incorporated or built within expander 617 in that expander 617 and augmenting motor 643 constitute a single unit. Thus, it is to be noted that either the compressor 616 or expander 617 may be either the piston type or rotor type or any other device that produces the same means and may be used in conjunction with any of the embodiments discussed herein.

In general, referring to both piston and rotary systems, it may be advantages that the output of the evaporator 612 should be substantial to be able to produce enough vapor and pressure as to maintain a pushing force on the expander 617. If the augmenting device 643 causes the evacuation of too much vapor from chamber 612, the pressure in chamber 612 will drop to the point where it no longer has a pushing force on the expander 617 and the system becomes powered solely by the augmenting device 643. A regulator (not shown in FIG. 6), may be incorporated to regulate the rate at which the augmenting device 643 causing the evacuation of vapor from chamber 612 such that to turn it off when it reaches a point when the pressure drops to a level that the pushing force of chamber 612 onto the expander 617 becomes ineffective. This type of regulator may also be incorporated in the augmenting device when using the piston type systems described earlier.

The augmenting device 643 has a multi-purpose in that it lowers the pressure, and thus, the boiling point of the refrigerant in chamber 612, and augments the system to be pushed forward.

All other components depicted in FIG. 6 (augmenting devise 643, expansion valves 675*a-b*, sensors 688*a-b*, 3-way valves 666*a-b*, pumps 641 and 642, evaporator 611 and 612 condensers 613 and 613*a*), have the same role and function the same as described earlier when referring to FIGS. 5*a-b*.

Similar to the displacement ratio between piston 522 and piston 521, the displacement ratio between expander 617 and compressor 616 is not under any limitation, but may be greater, or less than or equal to 1.

Figure 7:
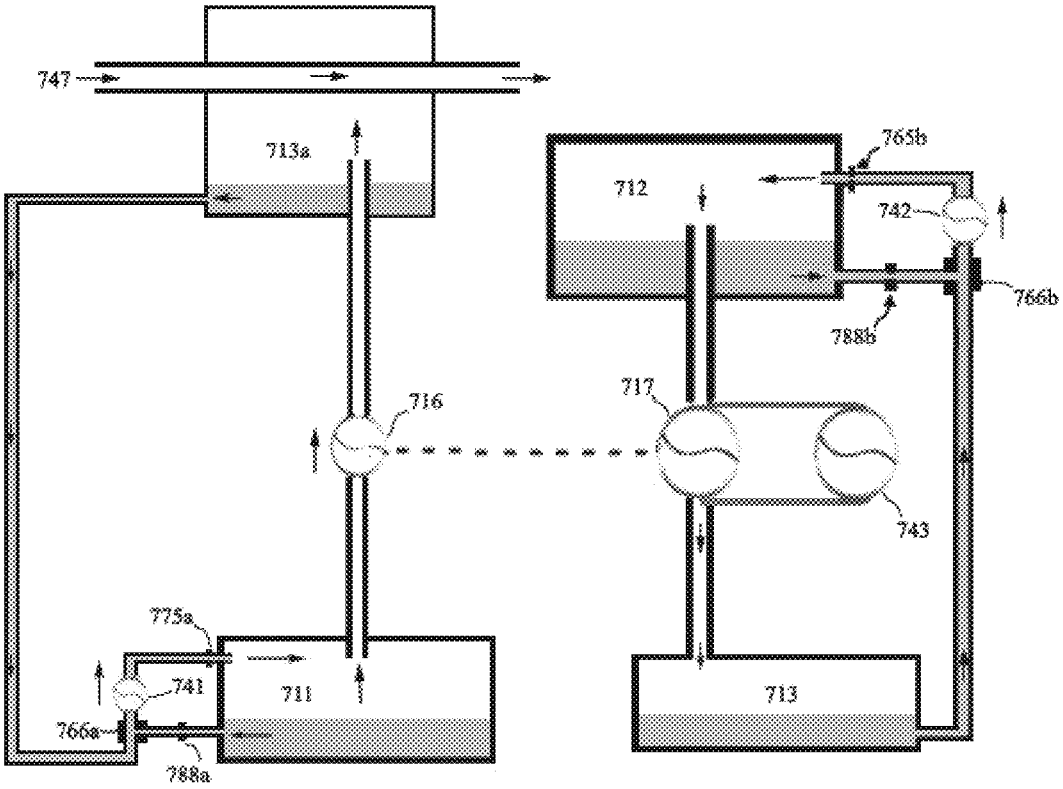
FIG. 7 depicts a mechanical advantage system configured to heat fluid, according to another embodiment.

FIG. 7 depicts a mechanical advantage system, using two refrigerants, coupled to an augmenting device 743 to heat water, according to another embodiment. This system comprises two evaporators (712 and 711) and two condensers (713 and 714). The first evaporator (chamber 712) and the second evaporator (chamber 711) may be placed in a space where surplus heat is available, such as an attic. The first condenser (chamber 713) may be placed outside the building and the second condenser (chamber 713*a*) heats cool, piped in water 747. As the refrigerant in chamber 713*a* condenses, it gives off heat to the cool water 747 that is piped in, and continues heating the water 747 as it passes through the condenser 713*a*. Condensed liquid refrigerant 733*a* is recycled and pumped from chamber 713*a* to chamber 711 by pump 741 and condensed refrigerant 713*b* from chamber 713 to chamber 712 by pump 742.

The following chart (Chart 4) is an illustration of a mechanical advantage system depicted in FIG. 7 using a combination of refrigerants, namely using refrigerant R-134a on the compressive side and R-410a on the expansive side.

CHART 4

(Refrigerant R-134a and R-410a)

| | | | |
|---|---|---|---|
| Chamber 711: | Temperature 60 F. | Pressure 57.4 psi | Refrigerant R-134a |
| Chamber 712 | Temperature 120 F. | Pressure 416.4 psi | Refrigerant R-410a |
| Chamber 713: | Temperature 110 F. | Pressure 364.1 psi | Refrigerant R-410a |
| Chamber 713a: | Temperature 120 F. | Pressure 171.17 psi | Refrigerant R-134a |

If A1=1 unit, we have $$(P4-P1)A1=(P2-P3)A2$$

$$(171.1-57.4)\text{ psi sq. in.}=(416.4-364.1)\text{ psi}\times A2.$$

$$113.7\text{ psi sq. in.}=52.3\text{ psi}(A2)$$

$$A2=2.17\text{ sq in.}$$

Thus, a mechanical advantage of at least 2.17 is required for the system depicted in FIG. 7 to operate if refrigerant R-134a is used on the compressive side and R-410a is used on the expansive side.

Again, implementing more suitable refrigerants having more appropriate vapor pressure properties relative to one another may produce greater chemical advantages. As previously described the mechanical advantage may further be enhanced by increasing the ratio of volume displacement by expander 717 relative to the volume displacement of compressor 716. For example, if A2 or the volume displaced by expander 717 were doubled, a total mechanical advantage of 4.34 would be observed.

In this system the compressor 716 draws refrigerant vapor from chamber 711 and compresses it into chamber/condenser 713*a*. The compressor 716 is power by the expander 717 which derives its energy from the difference of pressure between chamber 712 (evaporator) and chamber 713 (condenser). In addition energy may be supplemented to the system through an augmentation device 743 as described earlier.

Again, this system may also utilize expansion valves (775*a-b*), pumps (741 and 742, respectively), sensor 788*a-b* and 3-way valve 766*a-b* to further promote evaporation of the refrigerant in chamber/evaporator 711 and 712, respectfully, as described earlier when referring to FIGS. 5*a-b*.

In yet another embodiment, using similar principles as illustrated in FIG. 7, may be implemented to provide power to a steam turbine or other means for the production of energy. In this embodiment both evaporator (chamber 712) and the evaporator (chamber 711) absorbs heat from solar reflectors, mirrors or other source of heat. The condenser (chamber 713) may be placed outside and expel heat to the ambient air or other cooling means and the condenser (chamber 713*a*) heats, piped in water 747. As the refrigerant in chamber 713*a* condenses, it gives off heat to the cool water 747 that is piped in, and continues heating the water 747 as it passes through condenser 713*a*. The heated water 747 is heated sufficiently to cause boiling of the water and create steam to power a turbine. The use of augmenting devise 543,643 and 743 is optional and may or may not be used in connection with the embodiment relating to energy production.

Again, in both embodiments, referring to FIG. 7, and regarding heating water and powering a steam turbine, the two refrigerant system, may further be leveraged mechanically by increasing the ratio of volume displacement by expander 717 relative to the volume displacement of compressor 716.

Further, the embodiment of FIG. 7, described above, relating to powering a steam turbine, is not limited to using a two refrigerant system (chemical advantage) but both the expansive and compressive side of the system may be configured to use the same or a single type refrigerant and operate solely by using mechanical advantage to leverage the system. As previously described, mechanical leverage is achieved by configuring the volume displacement of the expansive side of the system be greater the volume displacement of compressor.

Although specific embodiments have been illustrated and described herein for the purpose of disclosing the preferred embodiments, someone of ordinary skills in the art will easily detect alternate embodiments and/or equivalent variations, which may be capable of achieving the same results, and which may be substituted for the specific embodiments illustrated and described herein without departing from the scope of the present invention. Therefore, the scope of this application is intended to cover alternate embodiments and/or equivalent variations of the specific embodiments illustrated and/or described herein. Hence, the scope of the present invention is defined by the accompanying claims and their equivalents. Furthermore, each and every claim is incorporated as further disclosure into the specification and the claims are embodiment(s) of the present invention.

What is claimed is:

1. A mechanical leverage system, in an air conditioning application, comprising a compressive side and an expansive side, said compressive side containing a first refrigerant and said expansive side containing a second refrigerant, and, with respect to temperature, said first refrigerant and said second refrigerant produce different vapor pressure behaviors from one another, wherein, said compressive side comprises a compressor which is in controlled fluid communication with a first evaporator and a first condenser, wherein, said expansive side comprises an expander which is in controlled fluid communication with a second evaporator and a second condenser, wherein, said second evaporator absorbs heat from an attic space and acts as a power system, and, said power system is configured to generate a gas-phase from a liquid-phase of said second refrigerant, resulting in an increase in pressure in said power system, and said second condenser is configured to expel heat to the outside of a building, and generate a liquid phase from a gas-phase of said second refrigerant, resulting in a decrease in pressure in said second condenser, wherein, the resultant difference in pressure between said power system and said second condenser drives said expander, and thus, said compressor to which said expander is connected; and wherein said first evaporator is configured for absorbing heat from inside of a building and generating a gas-phase from a liquid-phase of said first refrigerant, and, further said compressor is configured to compress gas-phase of said first refrigerant generated in said first evaporator into said first condenser, and said first condenser is configured to expel heat to the outside of a building, and generate a liquid-phase from a gas-phase of said first refrigerant and wherein there is a difference between the vapor pressure properties of said first refrigerant used in said compressive side and said second refrigerant used in said expansive side; such that said difference induces a mechanical advantage between said expander and said compressor.

2. The mechanical leverage system of claim 1, wherein a means is provided for delivery of liquid phase of said first refrigerant from said first condenser to said first evaporator and a second means is provided for delivery of liquid phase of said second refrigerant from said second condenser to said second evaporator.

3. The mechanical leverage system of claim 2, wherein said expander and said compressor displace different volumes of refrigerant during the same period of time to create the mechanical advantage.

4. The mechanical leverage system of claim 2, wherein at least one member of the group consisting of said first refrigerant and said second refrigerant comprises a fluid other than a refrigerant.

5. The mechanical leverage system of claim 2, wherein at least one member of the group consisting of said expander and said compressor is comprised of a rotary assembly.

6. The mechanical leverage system of claim 2, wherein means are provided for coupling energy to at least one member of the group consisting of said expander and said compressor.

7. The mechanical leverage system of claim 6, wherein said coupling energy lowers the boiling point of said second refrigerant in said second evaporator, enabling said second evaporator to absorb heat from its surroundings at decreased temperature levels.

8. The mechanical leverage system of claim 2, in a mechanism for enhancing vaporization of liquid phase of said first refrigerant in said first evaporator, such that the rate of heat absorption from its surroundings is increased, comprising a first pump for compressing and pressurizing liquid phase of said first refrigerant to a pressure level sufficiently higher than said first evaporator and emitted through a first expansion valve into said first evaporator, resulting in an increased rate of vaporization of liquid phase of said first refrigerant.

9. The mechanical leverage system of claim 2, in a mechanism for enhancing vaporization of liquid phase of said second refrigerant in said second evaporator, such that the rate of heat absorption from its surroundings is increased, comprising a second pump for compressing and pressurizing liquid phase of said second refrigerant to a pressure level sufficiently higher than said second evaporator and emitted through a second expansion valve into said second evaporator, resulting in an increased rate of vaporization of liquid phase of said second refrigerant.

10. The mechanical leverage system of claim 8, further comprising a mechanism for enhancing vaporization of liquid phase refrigerant by providing means for re circulating and pumping un-vaporized, accumulated, liquid phase of said first refrigerant from said first evaporator through said first expansion valve.

11. The mechanical leverage system of claim 9, further comprising a second mechanism for enhancing vaporization of liquid phase of said first refrigerant by providing means for recirculating and pumping un-vaporized, accumulated, liquid phase refrigerant from said second evaporator through said second expansion valve.

12. The mechanical leverage system of claim 1, wherein said attic space is bounded between the roof and ceiling of a building.

13. The mechanical leverage system of claim 2, wherein at least one member of the group consisting of said expander and said compressor is comprised of a piston cylinder assembly.

* * * * *